United States Patent [19]

Bychinsky

[11] 3,948,349

[45] Apr. 6, 1976

[54] WAVE INTERFERENCE SILENCER

[75] Inventor: Wilfred A. Bychinsky, Burton, Mich.

[73] Assignee: General Motors Corporation, Detroit, Mich.

[22] Filed: May 12, 1975

[21] Appl. No.: 576,722

[52] U.S. Cl. ..... 181/44; 181/67

[51] Int. Cl.[2] ..... F01N 1/12

[58] Field of Search ..... 181/33 L, 36 B, 41, 44, 181/46, 56, 66, 67

[56] References Cited

UNITED STATES PATENTS

| | | | |
|---|---|---|---|
| 2,031,451 | 2/1936 | Austin | 181/44 |
| 2,924,296 | 2/1960 | Cook | 181/67 X |
| 3,135,350 | 6/1964 | Mattie | 181/56 |
| 3,580,357 | 5/1971 | Whitney | 181/44 |
| 3,805,495 | 4/1974 | Steel | 181/67 X |
| 3,888,331 | 6/1975 | Wang | 181/44 |

*Primary Examiner*—Lawrence R. Franklin
*Attorney, Agent, or Firm*—J. C. Evans

[57] ABSTRACT

A wave interference silencer assembly is disclosed for attenuating low frequencies without extension of the length of an inner tube component of a helical path wave interference silencer having a pair of exhaust flow tubes of equal length. A twisted ribbon component is twisted along its length to define an acoustical path length in one of the tubes longer than the length of the tube to produce attenuation of lower frequencies while retaining substantially equally divided exhaust volume flow through the first and second tubes.

4 Claims, 5 Drawing Figures

WAVE INTERFERENCE SILENCER

This invention relates to sound mufflers and more particularly to wave interference type mufflers including first and second exhaust flow tubes with means therein to produce acoustical flow paths of differing length for wave interference attenuation of sound frequencies in the exhaust flow through the device.

Wave interference type mufflers are disclosed in U.S. Pat. No. 3,580,357 issued May 25, 1971, to Whitney. Such mufflers have a compact configuration in part attributable to concentric tubes arranged to have exhaust flow path through an inner tube and exhaust flow through a space between two concentric tubes as defined by a helical baffle wound between the two tubes.

Such arrangements have the advantage of defining two relatively open exhaust flow paths through which a total exhaust stream is divided including a flow path through the inner tube and a flow path through the helically wound baffle. In such arrangements, the outer path is selected to have three-quarters of the wave length of the frequency to be damped and the inner path will have a length one-quarter of the wave length to be cancelled.

The lowest sound frequency that can be cancelled thus is dependent on the one-quarter wave length of the inner tube. The length of the inner tube represents the lowest common denominator for wave length consideration and it results in a size limitation since lower sound frequencies can only be attenuated by use of very long tubes to produce wave interference attenuation of lower sound frequencies. Such elongated tube components are difficult to fit between an engine exhaust pipe and tail pipe components on present day vehicles and are even more difficult to fit on vehicle systems having reduced dimensional characteristics as in the case of subcompact vehicles.

Accordingly, an object of the present invention is to improve wave interference silencer devices by including means therein that attenuate sound frequencies lower than those corresponding to four times the length of the inner pipe.

A further object of the present invention is to provide an improved wave interference silencer assembly having first and second equal length tube components each of which receive approximately one-half of a total exhaust stream for reducing exhaust pressure drop across the silencer assembly and wherein at least one of the tubes includes a ribbon component therein having a width equal to the inside diameter of the one tube and being twisted along its length to produce an equivalent acoustical path length therein substantially greater than the length of the one tube per se so as to produce wave interference silencing of sound frequencies lower than produced by reliance solely upon the length of the tube component itself.

Yet another object of the present invention is to provide an improved wave interference silencer device including two parallel tubes having equal lengths, each having an inlet end and each having an outlet end, wherein adapter means direct an exhaust stream equally into the two parallel tubes and wherein one of the tubes includes a twisted ribbon therein having a width equal to the inner diameter of the one tube to define an acoustical path length in the one tube longer than the one tube for producing attenuation of a range of lower sound frequencies in the exhaust flow through the parallel tubes.

Yet another object of the present invention is to provide an improved, easily assembled, wave interference silencer capable of attenuating sound frequencies lower than four times the length of tube components therein; said silencer including a pair of concentric tubes having equal length, the inner tube containing a ribbon twisted along its length having a width equal to the inner diameter of the inner tube to produce a first acoustical path longer than that of the length of inner tube and wherein a space between the concentrically arranged tubes contains a helically formed baffle having a pitch to produce an equivalent acoustical length in the space approximately 3 times that of the first acoustical path.

Further objects and advantages of the present invention will be apparent from the following description, reference being had to the accompanying drawings wherein a preferred embodiment of the present invention is clearly shown.

Figure 1:
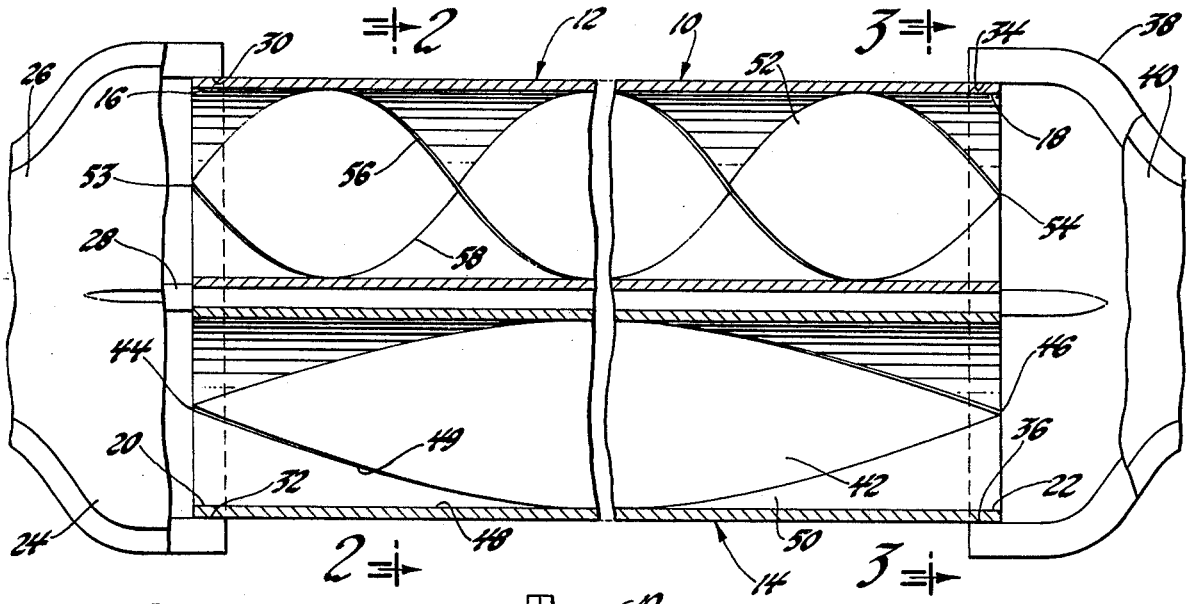
FIG. 1 is a view in longitudinal section of a silencer constructed in accordance with the present invention.

Referring now to the drawing, in FIG. 1 a wave interference silencer assembly 10 is illustrated including a pair of tubes 12, 14. Each of the tubes has its longitudinal axis located in spaced parallelism with the adjacent tube. Each tube 12, 14 is rolled from a flat sheet joined at longitudinal joints 15, 17, respectively. Tube 12 includes an inlet end 16 and an outlet end 18. Tube 14 likewise includes an inlet end 20 and an outlet end 22. An inlet adapter 24 has an inlet end 26 thereon adapted to be connected to the exhaust pipe of an engine. A separator plate 28 within the adapter 24 divides the engine exhaust flow into approximately equal volumes for passage into the inlet ends 16, 20 of the tubes 12, 14 received with adapter bores 30, 32, respectively.

In the illustrated arrangement, each of the tubes 12, 14 are of equal length and each of them has its outlet end supported within bores 34, 36, respectively, in the end of an adapter 38 having an outlet end 40 thereon for connection to the tailpipe of a vehicle.

In order to adapt the assembly 10 for wave interference attenuation of lower sound frequencies than those dependent on the length of one of the tubes 12, 14, a first ribbon 42 is located within the tube 14. It has an inlet edge 44 and an outlet edge 46, each located in a horizontal plane through the tube axis. The ribbon 42 has a width equal to the inside diameter of the tube 14 so that edge portions 47, 49 thereon will continually engage diametric points on the inner surface of the tube 48 to define an elongated acoustical path 50 through the tube 14 greater than the length of the tube 14.

Figure 2:
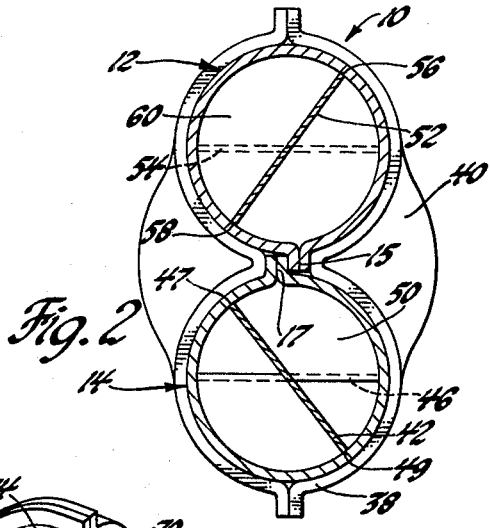
FIG. 2 is a vertical section taken along the line 2—2 of FIG. 1.
Figure 3:
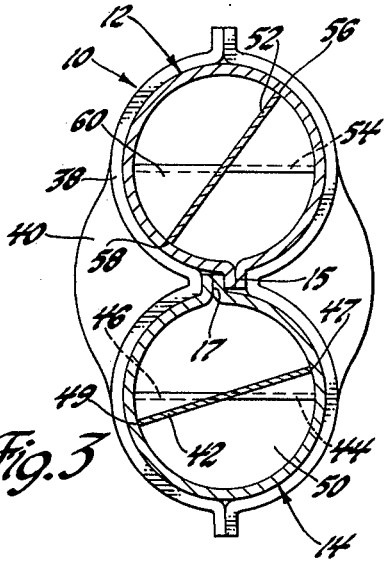
FIG. 3 is a vertical sectional view taken along the line 3—3 of FIG. 1.

A second twisted ribbon component 52 is located within the tube 12. It has opposite ends 53, 54 located in a common horizontal plane twisted three times along its length as shown in FIGS. 1 through 3 and likewise includes a width equal to the inner diameter of the tube 12 so that spaced edges 56, 58 thereon will continuously contact diametric points on the inner surface of the tube 12 so as to define an acoustical path therethrough approximately 3 times longer than the acoustical path 50 through the tube 14.

By the provision of the twisted ribbon 42 within the tube 14 the acoustical path through the tube 14 is substantially greater than the length of the tube 14. This path, along with the greater length acoustical path 60 through the tube 12 enables lower frequencies to be attenuated by wave interference action at the outlet adapter 38 than would be the case if attenuation were dependent upon the length of one or the other of the tubes 12, 14.

In addition to producing attenuation of lower sound frequencies by wave interference of the exhaust flow at the outlets of tubes 12, 14, exhaust flow is maintained substantially equally distributed through the tubes 12, 14 to minimize pressure drop across the two flow components of the assembly. Furthermore, the fact that substantially one half of the total exhaust flow passes through each of the tubes 12, 14 assures that each of the tubes will be continually swept by exhaust gas so as to avoid collection of condensate therein.

Figure 4:
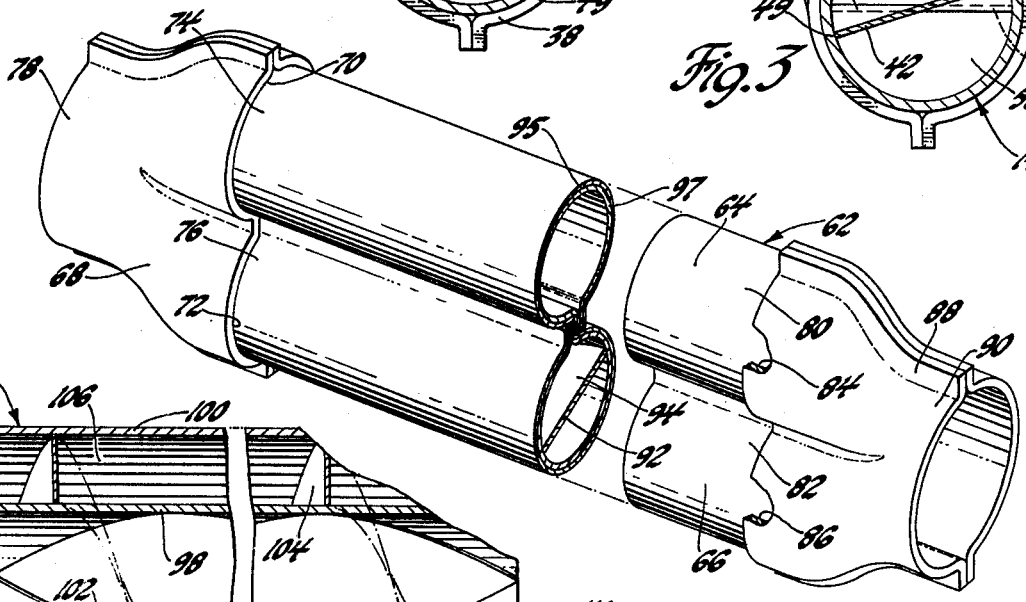
FIG. 4 is a perspective view of a second embodiment of the present invention having an open tube component therein.

Referring now to the embodiment of FIG. 4, a second wave interference silencer assembly 62 is illustrated again including two parallel tubes 64, 66 of equal length. As in the case of the first embodiment, the tubes 64, 66 are joined at the inlet end thereof to an adapter 68 having bores 70, 72 thereof receiving the inlet ends 74, 76, respectively, of the tubes 64, 66. The adapter 68 has an inlet end 78 thereon for connection to the exhaust pipe of an internal combustion engine. The outlet ends 80, 82 of the tubes 64, 66 are received in bores 84, 86 of an adapter 88. The adapter 88 includes an outlet 90 thereon adapted to be connected to the tailpipe of a vehicle. While the embodiment of FIG. 4 corresponds to configuration of that in FIGS. 1 through 3 it also differs therefrom in that the tube 64 is completely open throughout its length whereby the acoustical path therethrough corresponds to the length of tube 64 between the bores 70, 84. The tube 66 includes a twisted ribbon 92 having a width equal to the inside diameter of the tube 66 and a pitch that will produce an acoustical path 94 through the tube 66 having a length to produce a greater path length than that through the straight tube 64 thereby to produce an out-of-phase shift in the sound waves emitted from the inlet to the outlet end of the tubes 64, 66 to produce wave interference silencing of predetermined lower frequencies.

By using parallel tubes, as in the embodiments of FIG. 4, the tubes 64, 66 can be made of two layers 95, 97 with the inner layer of a high temperature material and the outer layer being a low cost material. This reduces the overall cost of the assembly while maintaining a good corrosion resistance on the inside of the tube where required.

Figure 5:
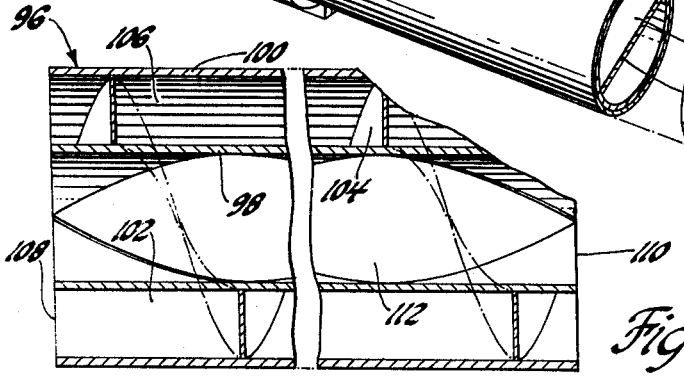
FIG. 5 is a view in longitudinal section of a third embodiment of the present invention.

In the embodiment of FIG. 5, a wave interference silencer 96 is illustrated. It includes an inner tube 98 that will receive approximately fifty percent of exhaust flow through the device 96. The inner tube 98 is located radially inwardly of and concentrically with respect to an outer tube 100 to define an annular space 102 therebetween. As in the case of wave interference silencers of the type set forth in the aforesaid Whitney patent, the space 102 is occupied by a helically formed baffle 104 that defines an extended acoustical flow path 106 to the space 102 between an inlet end 108 and an inlet end 110 of the device 96.

In the aforesaid mentioned Whitney type wave interference silencer devices, the lowest frequency that can be cancelled by concentrically arranged tubes is one in which the lower frequency is of a wave length approximately 4 times the wave length of the inner tube. Thus for lower frequency noise attenuation it has been necessary to include a long inner tube 98. In accordance with the present invention, shorter length inner tubes 98 can be retained and an equivalent acoustical length increase is produced by the provision of a twisted flat ribbon 112 having a width equal to the inside diameter of the inner tube 98 and being twisted to have a pitch to produce an acoustical flow path length through the inner tube 98 greater than the length of the tube 98. The outer tube path 106 defined by the helical baffle 104 has a pitch to give a cancellation effect at the outlet 110.

Wave interference silencers are more adaptable because of the invention since the lower frequencies generated in an exhaust system that would otherwise require very long inner tubes such as tube 98 in the embodiment of FIG. 5 are attenuated by the provision of the equivalent length acoustical path produced by the twisted inner ribbon 112.

While the embodiments of the present invention, as herein disclosed, constitute a preferred form, it is to be understood that other forms might be adopted.

What is claimed is:

1. A wave interference silencer comprising a first tube having opposite open ends, a second tube having a length equal to that of said first tube also including opposite open ends, adapter means for directing exhaust flow into one end of each of said first and second tubes, second adapter means for receiving exhaust flow from the opposite ends of said first and second tubes, a twisted ribbon element located within at least one of said tubes including spaced apart edges thereon located in engagement with the inner circumference of said one tube to define a flow path through said one tube having a greater acoustical length than the path through the other tube to produce wave interference attenuation of sound frequencies in exhaust flow through said first and second tubes.

2. A wave interference silencer assembly for sound attenuation comprising first and second tubes each having substantially equal lengths, means for directing exhaust flow into each of said tubes with about fifty percent of the exhaust flow passing through each of said first and second tubes, a twisted ribbon component located within one of said tubes and extending the length thereof, said twisted ribbon having parallel side edges thereon in engagement with diametric points on the inner circumference of said one of said tubes to define an acoustical path through said one of said tubes of a length greater than that of the acoustical path through the other tube to increase the range of acoustical attenuation of sound frequencies in the equally divided exhaust flow through said first and second tubes.

3. A wave interference silencer comprising first and second tubes, one of said tubes being located concentrically within the other tube and having a length corresponding to that of the other tube, a twisted ribbon located in the inner tube having spaced apart side edges thereon in engagement with diametric points on the inner circumference of said inner tube, a helical baffle located in the space between said first and second tubes having a pitch to define an acoustical path through the space between said first and second tubes approximately three times that of the acoustical path defined by the twisted ribbon supported within said inner tube for producing wave interference silencing of a lower frequency than that dependent on the length of either of said first and second tubes.

4. A wave interference silencer comprising first and second tubes having equal length, each of said tubes having the longitudinal axis thereof located in spaced parallelism, each of said tubes having opposite open ends thereon, adapter means for directing an exhaust volume into each of said tubes and for dividing exhaust flow substantially equally therebetween, second adapter means for receiving exhaust flow from each of said tubes for combining the equally divided exhaust flow therethrough into a single stream, one of said tubes having an acoustical length therethrough equal to the length of said tube, a ribbon element located in the other of said tubes twisted along the longitudinal axis thereof and including spaced apart parallel side edges thereon in engagement with diametric points on the inner circumference of the other of said tubes to define an acoustical path through the other of said tubes of a greater length than that acoustical path through said one of said tubes for producing wave interference attenuation of sound in the exhaust flow through said tubes.

* * * * *